US009450353B2

(12) United States Patent
Yudate

(10) Patent No.: US 9,450,353 B2
(45) Date of Patent: Sep. 20, 2016

(54) MULTIPOLE JACK COMPRISING A MAIN BODY INSERTED WITHIN A CASE

(71) Applicant: EX Company Limited, Matsuyama-shi, Ehime (JP)

(72) Inventor: Shinya Yudate, Matsuyama (JP)

(73) Assignee: EX COMPANY LIMITED, Matsuyama-shi (JP)

( * ) Notice: Subject to any disclaimer, the term of this patent is extended or adjusted under 35 U.S.C. 154(b) by 0 days.

(21) Appl. No.: 14/760,027

(22) PCT Filed: Dec. 12, 2013

(86) PCT No.: PCT/JP2013/007328

§ 371 (c)(1),
(2) Date: Jul. 9, 2015

(87) PCT Pub. No.: WO2014/112007

PCT Pub. Date: Jul. 24, 2014

(65) Prior Publication Data

US 2015/0349475 A1 Dec. 3, 2015

(30) Foreign Application Priority Data

Jan. 15, 2013 (JP) ..... 2013-004278

(51) Int. Cl.
*H01R 24/00* (2011.01)
*H01R 24/58* (2011.01)
(Continued)

(52) U.S. Cl.
CPC ..... *H01R 24/58* (2013.01); *H01R 43/16* (2013.01); *H01R 2107/00* (2013.01); *Y10T 29/4921* (2015.01)

(58) Field of Classification Search
CPC ..... H01R 24/58; H01R 2101/00; H01R 2105/00; H01R 2107/00
USPC ..... 439/668, 669
See application file for complete search history.

(56) References Cited

U.S. PATENT DOCUMENTS 7,963,786 B1 * 6/2011 Su ..... H01R 24/58 439/271
8,162,672 B2 * 4/2012 Huang ..... H01R 13/11 439/580

(Continued)

FOREIGN PATENT DOCUMENTS

JP 2002-134237 A 5/2002
JP 2009-4145 A 1/2009

(Continued)

OTHER PUBLICATIONS

International Search Report dated Jan. 28, 2014, issued in corresponding application No. PCT/JP2013/007328 (2 pages).

*Primary Examiner* — Vanessa Girardi
(74) *Attorney, Agent, or Firm* — Westerman, Hattori, Daniels & Adrian, LLP

(57) ABSTRACT

A multipole jack includes a main body and a case. The substantially cylindrical main body includes terminal bases which make contact with electrodes of a multipole plug. Connecting ends of the terminal bases are led out from the main body. The main body is attached to the substantially bottomed cylindrical resin case through an opening of the case. Inner ends of extension terminals which protrude from side walls of the case and are insert-molded are electrically connected to the connecting ends of the corresponding terminal bases. Therefore, it is possible to further increase a battery size of an electronic device in which a multipole jack is provided by decreasing an entire length of the multipole jack, and to meet the demand for reducing the size of a multipole jack by reducing the length of terminals.

18 Claims, 6 Drawing Sheets

(51) Int. Cl.
*H01R 43/16* (2006.01)
*H01R 107/00* (2006.01)

(56) References Cited

U.S. PATENT DOCUMENTS

2002/0052148 A1 5/2002 Nagata
2004/0248473 A1* 12/2004 Wang ..... H01R 24/64 439/676
2009/0305571 A1* 12/2009 Chen ..... H01R 24/58 439/660
2010/0197172 A1 8/2010 Yudate
2013/0065445 A1* 3/2013 Nagata ..... H01R 13/5213 439/625

FOREIGN PATENT DOCUMENTS

JP 2009-104867 A 5/2009
JP 2012-14863 A 1/2012
JP 2012-155873 A 8/2012

* cited by examiner

MULTIPOLE JACK COMPRISING A MAIN BODY INSERTED WITHIN A CASE

TECHNICAL FIELD

The present invention relates to a multipole jack used for electrical connection of various electronic devices such as, for example, a multi-functional mobile phone or a mobile information terminal, a method for manufacturing the same, and an electronic device.

BACKGROUND ART

Conventionally, a multipole plug and a multipole jack have been used for electrical connection of various electronic devices. For example, a connector includes a multipole plug provided in a peripheral electronic device such as a headphone and a multipole jack provided in a main body of an electronic device such as a multi-functional mobile phone or a portable music player.

Patent Document 1 discloses an example of a multipole jack. In this multipole jack, a number of terminal bases corresponding to the number of poles of a multipole plug are provided in a housing. The terminal bases are extended linearly toward the rear side from a rear opening of the housing and are led out to the rear side while passing through a slit formed in a planar rubber member that closes the rear opening. Further, a cover member that fixes and holds the planar rubber member at a predetermined position is provided in the rear opening of the housing. Extension terminals extended to the outside from terminals are provided in the cover member so as to correspond to the terminal bases. Inner ends of the extension terminals are inserted into connecting grooves at the ends of the terminal bases led out to the rear side from the planar rubber member. In this way, the terminal bases and the extension terminals are electrically connected.

In this multipole jack, the elastic planar rubber member having a shape corresponding to the rear opening of the housing is inserted into the rear opening to secure watertightness between the rear opening and the planar rubber member. Further, the terminal bases are sandwiched by the slit of the elastic planar rubber member to secure watertightness of the portion through which the terminal bases pass. In this way, a waterproof structure for the rear opening of the housing, through which terminals are led out to the outside is formed. As a result, it is not necessary to fill adhesive between a circumferential edge of the planar rubber member and an inner circumferential surface of the rear opening of the housing and between the slit and the terminal bases. Thus, it is possible to obviate deterioration of waterproofness, which may occur when the adhesive is removed due to a difference in thermal expansion/contraction coefficient when extension terminals are soldered. That is, it becomes possible not to seal the rear opening of the housing, through which terminals are led out, using adhesive, and to eliminate deterioration of waterproofness which may occur when terminals are soldered.

CITATION LIST

Patent Document

Patent Document 1: Japanese Unexamined Patent Application Publication No. 2012-155873

SUMMARY OF INVENTION

Problems to be Solved by the Invention

There is a strong demand for using a large-size battery in order to extend a battery-driven time of a mobile electronic device such as a multi-functional mobile phone or a mobile information terminal. However, in the multipole jack of Patent Document 1, terminals are led out in the longitudinal direction of the housing from the rear opening. Thus, the entire length of the multipole jack increases, which makes it difficult to increase the size of a battery disposed on the rear side of the multipole jack.

Moreover, when terminals of a multipole jack are led out from the rear side, a terminal having its plug contact at a position close to an insertion opening has a large length. However, when a terminal length increases, it is difficult to dispose terminals at an appropriate position in a housing, which makes it difficult to meet the demand for reducing the size of a multipole jack. This problem becomes more considerable as the number of poles of the multipole jack increases.

The present invention is proposed to solve the above problems and an object thereof is to provide a multipole jack, a method for manufacturing the same, and an electronic device capable of further increasing a battery size of an electronic device in which a multipole jack is provided by decreasing an entire length of the multipole jack, and meeting the demand for reducing the size of a multipole jack by reducing the length of terminals provided therein even if the number of poles increases.

Solution to Problem

A multipole jack according to the present invention has a configuration in which terminal bases that make contact with electrodes of a multipole plug are provided in an approximately cylindrical main body, connecting ends of the terminal bases are led out from the main body, the main body is attached to an approximately bottomed cylindrical resin case from an opening of the case, and inner ends of extension terminals which protrude through side walls of the case and which are insert-molded are electrically connected to the connecting ends of the corresponding terminal bases.

According to this configuration, terminals can be led out from the lateral sides rather than the rear side. Thus, it is possible to decrease an entire length of the multipole jack and to further increase a battery size of an electronic device in which the multipole jack is provided. Moreover, the terminal base having the plug contact disposed close to the opening of the main body through which the plug is inserted can be shortened by being led out from the lateral sides. Thus, it is possible to decrease the length of terminals provided and to meet the demand for reducing the size of the multipole jack even if the number of poles increases. Further, the deeper surface and desired upper, lower, left, and right regions of the main body can be waterproofed reliably by the approximately bottomed cylindrical resin case. Further, since the extension terminals are insert-molded into the case, adhesive is not removed during soldering of the extension terminals. Thus, it is possible to prevent deterioration of waterproofness during soldering of the extension terminals and to obtain high yield. Further, since it is only necessary to change the configuration of a jack without changing the configuration of a housing of the electronic device and an expensive housing-side mold used for manufacturing the electronic device, it is possible to reduce the manufacturing cost for the electronic device.

In the multipole jack according to the present invention, the inner ends of the extension terminals provided on each of both side walls of the case are electrically connected to the connecting ends of the corresponding terminal bases.

According to this configuration, since terminals are led out from both side walls, it is possible to cope with an increase in the number of poles such as five poles to ten poles larger than four poles, for example.

In the multipole jack according to the present invention, the terminal bases electrically connected to cylindrical electrodes of the multipole plug are disposed on lateral portions of the main body, and the connecting ends of all terminal bases are led out from the lateral sides of the main body.

Further, the terminal bases corresponding to the cylindrical electrodes of the multipole plug are disposed on the lateral portions of the main body, and the connecting ends of all terminal bases are led out from the lateral sides and are connected to the inner ends of the extension terminals on the inner side of the side walls of the case. Thus, it is possible to substantially minimize the length of the terminal bases and the entire length of the terminal made up of the terminal bases and the extension terminals. Therefore, it is possible to design the multipole jack so as to cope with an increase in the number of poles more reliably and to meet the demand for reducing the size of the multipole jack reliably.

In the multipole jack according to the present invention, the connecting ends of the terminal bases are formed in a plate spring form and are connected by making press-contact with the extension terminals of the case.

According to this configuration, it is possible to eliminate thermal effect on the terminal bases, the extension terminals, and the surroundings thereof, which occurs when the terminal bases and the extension terminals are connected by soldering and to realize electrical connection between the connecting ends and the extension terminals more reliably and easily.

In the multipole jack according to the present invention, the plate spring-shaped connecting ends each include a plurality of elastic branching contact chips.

According to this configuration, since a plurality of branching contact chips and a plurality of contact points are provided in each terminal, it is possible to secure a conduction state between the terminal bases and the extension terminals more reliably. Moreover, even when the spring property of one branching contact chip deteriorates, a conduction state can be secured by the other branching contact chip.

In the multipole jack according to the present invention, at least the plate spring-shaped connecting ends of the terminal bases corresponding to the cylindrical electrodes of the multipole plug are provided so as to have a curved portion that is curved so as to be convex toward a bottom portion side of the case.

According to this configuration, the main body having the terminal bases of which the connecting ends are formed in a plate spring form can be inserted into the case smoothly, and the manufacturing efficiency can be improved.

In the multipole jack according to the present invention, a flange portion is formed integrally around the opening of the case.

According to this configuration, for example, when the multipole jack is attached to the housing of the electronic device by forming a packing such as a waterproof double-sided tape, an O-ring, or a silicone between a front surface (a plug-insertion-side surface) of the flange portion and a predetermined portion of the housing, the flange portion can prevent entrance of water into the housing from the outside of the case.

In the multipole jack according to the present invention, the main body has such a length that the main body protrudes from the case, and the flange portion of the case is disposed at a position corresponding to an intermediate portion of the main body.

According to this configuration, a region between the distal end of the main body and the flange portion can be effectively used for various uses.

In the multipole jack according to the present invention, the inner ends of the extension terminals of the case are formed in a plate spring form and are connected by making press-contact with the connecting ends of the terminal bases.

According to this configuration, it is possible to eliminate thermal effect on the terminal bases, the extension terminals, and the surroundings thereof, which occurs when the terminal bases and the extension terminals are connected by soldering and to realize electrical connection between the connecting ends and the extension terminals more reliably and easily.

A method for manufacturing a multipole jack according to the present invention includes arranging a desired number of terminal bases smaller than a predetermined number of terminal bases at appropriate positions of arrangement positions for the predetermined number of terminal bases using a mold having the arrangement positions for the terminal bases and insert-molding the desired number of terminal bases into a resin in this state to form the main body.

According to this configuration, the number of poles of the multipole jack can be adjusted by adjusting the number of terminal bases of the main body, and the multipole jacks having different numbers of poles can be manufactured using the same mold for the main body and the case. Thus, it is possible to improve the manufacturing efficiency by sharing the manufacturing lines and to suppress the cost for expensive molds to reduce the manufacturing cost. Moreover, when the number of terminal bases is decreased, the multipole jack in which extension terminals of the case, which do not have the corresponding terminal bases are formed as dummy extension terminals can be manufactured. Thus, a fragile resin protrusion is prevented from being formed in the dummy extension terminals of the case when the multipole jacks having different numbers of poles are manufactured using the same mold for the main body and the case.

An electronic device according to the present invention includes the multipole jack according to the present invention, in which the extension terminals and housing-side terminals are electrically connected at a position on the lateral sides of the side walls of the case in a plan view.

According to this configuration, it is possible to obtain an electronic device such as a mobile electronic device having the effects of the multipole jack according to the present invention. Moreover, in an electronic device having such a structure that a battery is disposed on the rear side of the multipole jack, by connecting the extension terminals and the housing-side terminals of the electronic device on the lateral sides of the side walls, the rear-side space for connecting both terminals can be effectively used for the space for increasing the battery size. Thus, the battery size of the electronic device can be increased reliably.

Effects of the Invention

According to the present invention, it is possible to further increase a battery size of an electronic device in which a multipole jack is provided by decreasing an entire length of the multipole jack, and to meet the demand for reducing the size of a multipole jack by reducing the length of terminals provided therein even if the number of poles increases.

MODE FOR CARRYING OUT THE INVENTION

[Multipole Jack and Method for Manufacturing the Same According to Embodiment]

A multipole jack 1 of the present embodiment is used in a mobile electronic device such as a multi-functional mobile phone or a mobile information terminal. As illustrated in FIGS. 1 to 4, the multipole jack 1 includes an approximately cylindrical main body 2 in which a multipole plug is inserted and an approximately bottomed cylindrical resin case 3. The main body 2 is inserted from an opening 31 of the case 3 so that the main body 2 is attached to the case 3.

Figure 1:
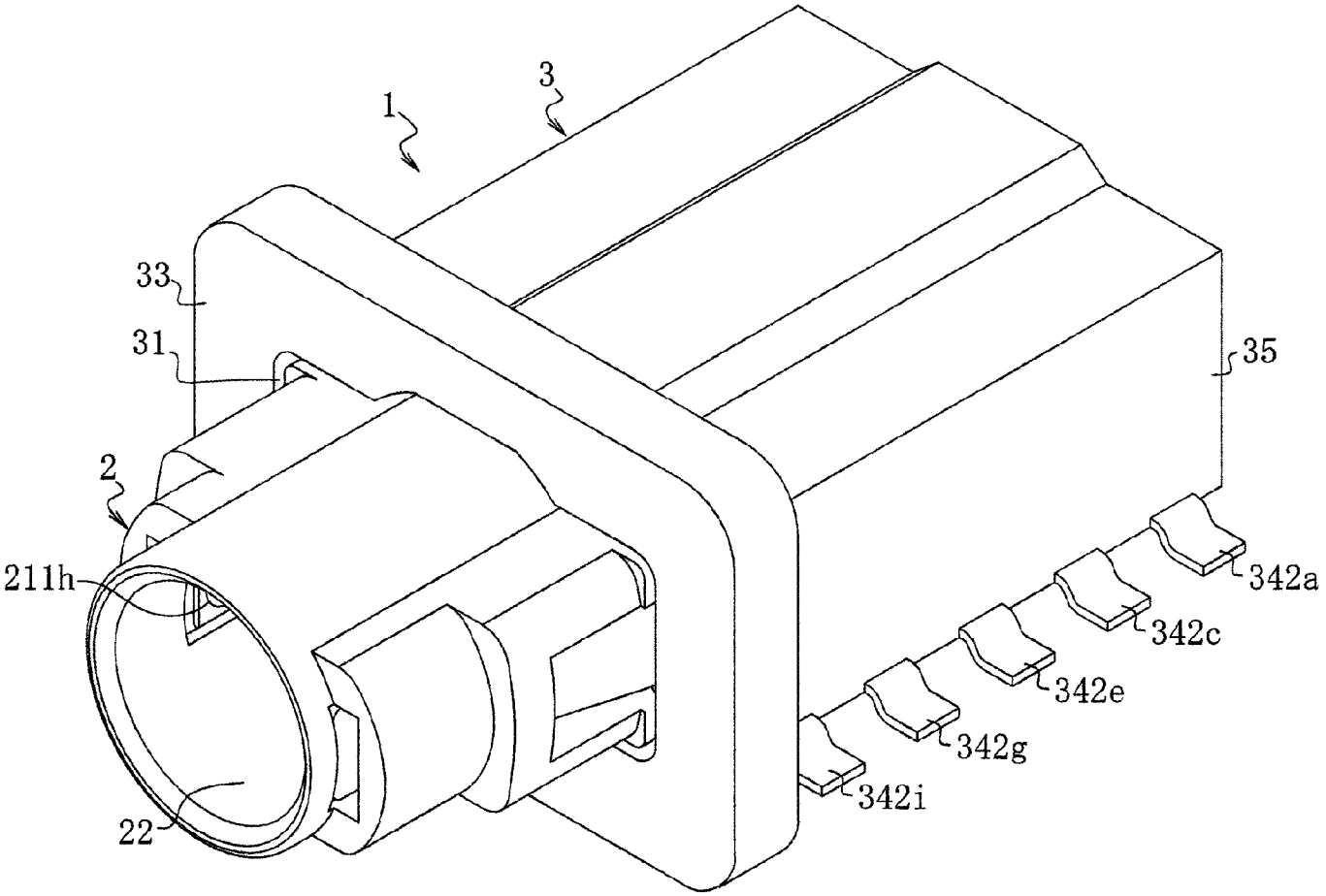
FIG. 1 is a perspective view of a multipole jack according to an embodiment of the present invention when seen obliquely from above.
Figure 2:
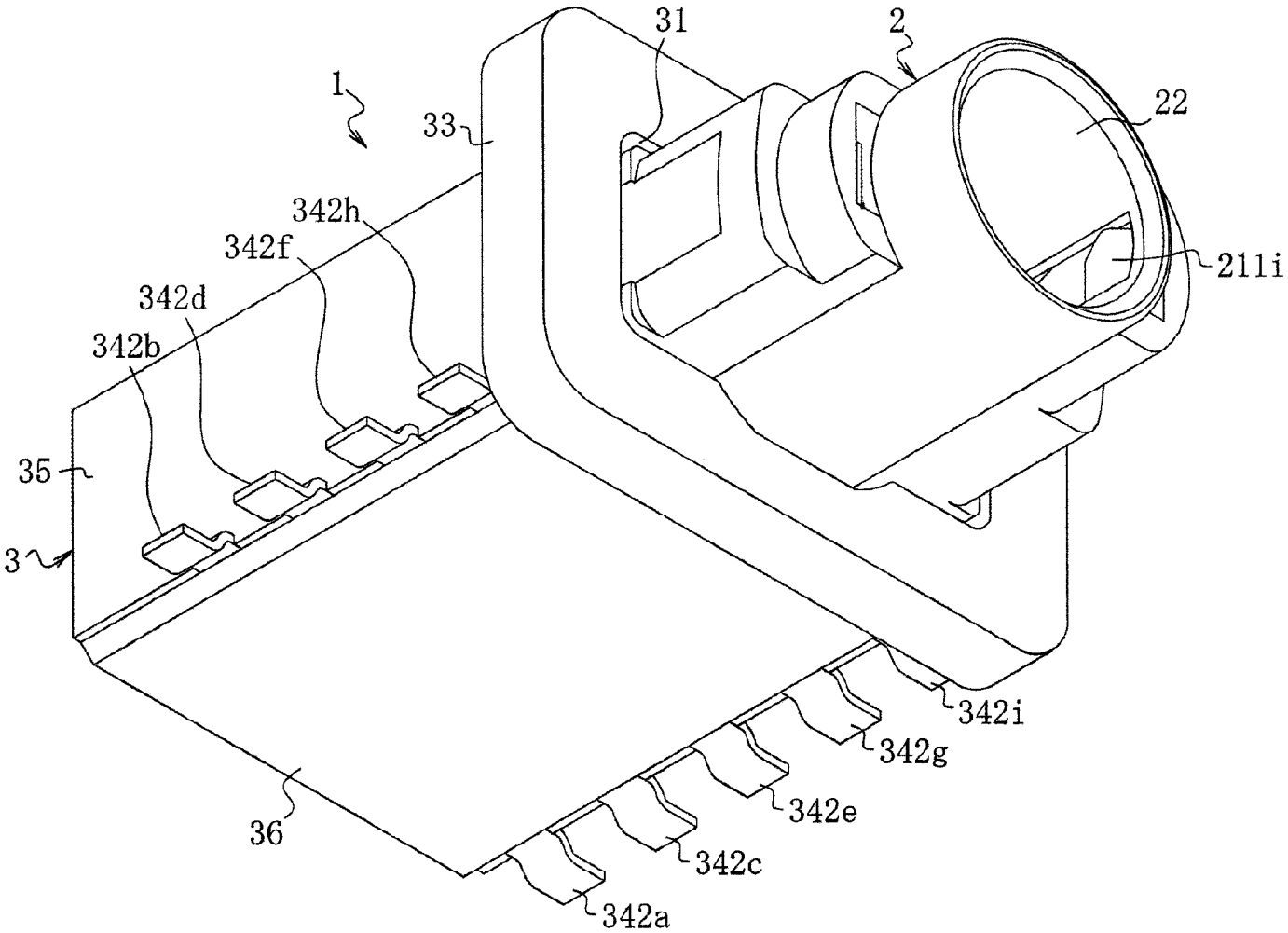
FIG. 2 is a perspective view of the multipole jack according to the embodiment of the present invention when seen obliquely from below.
Figure 3:
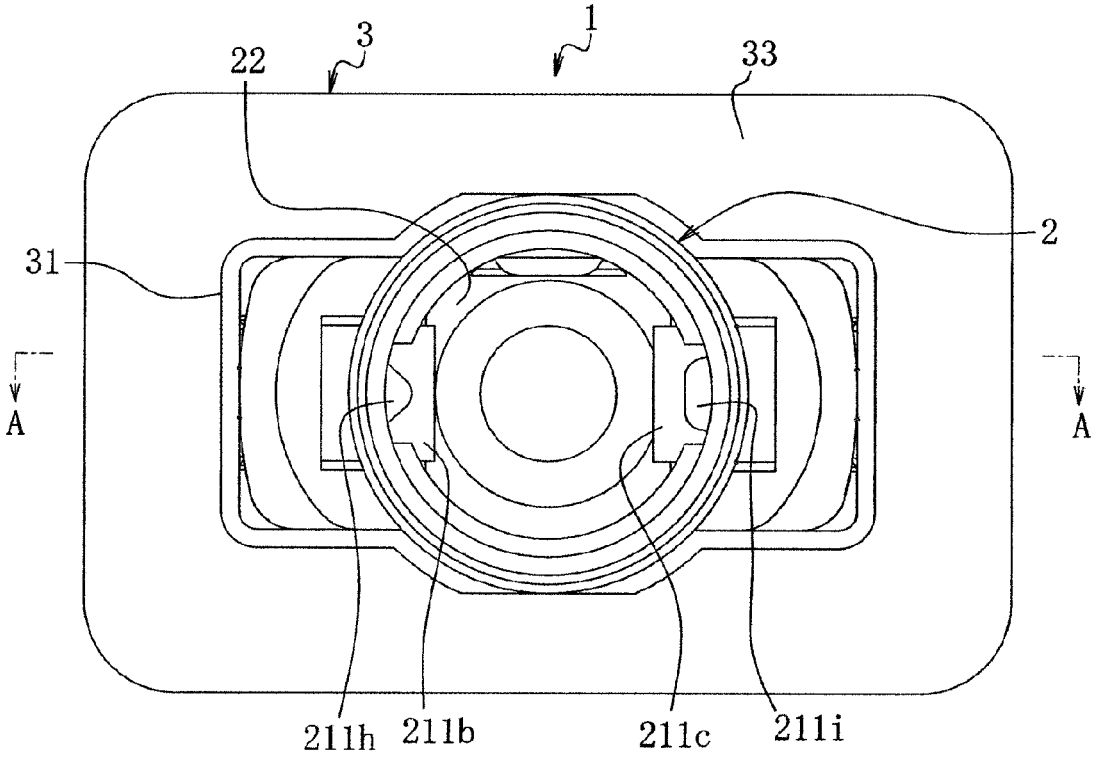
FIG. 3 is a front view of the multipole jack according to the embodiment of the present invention.
Figure 4:
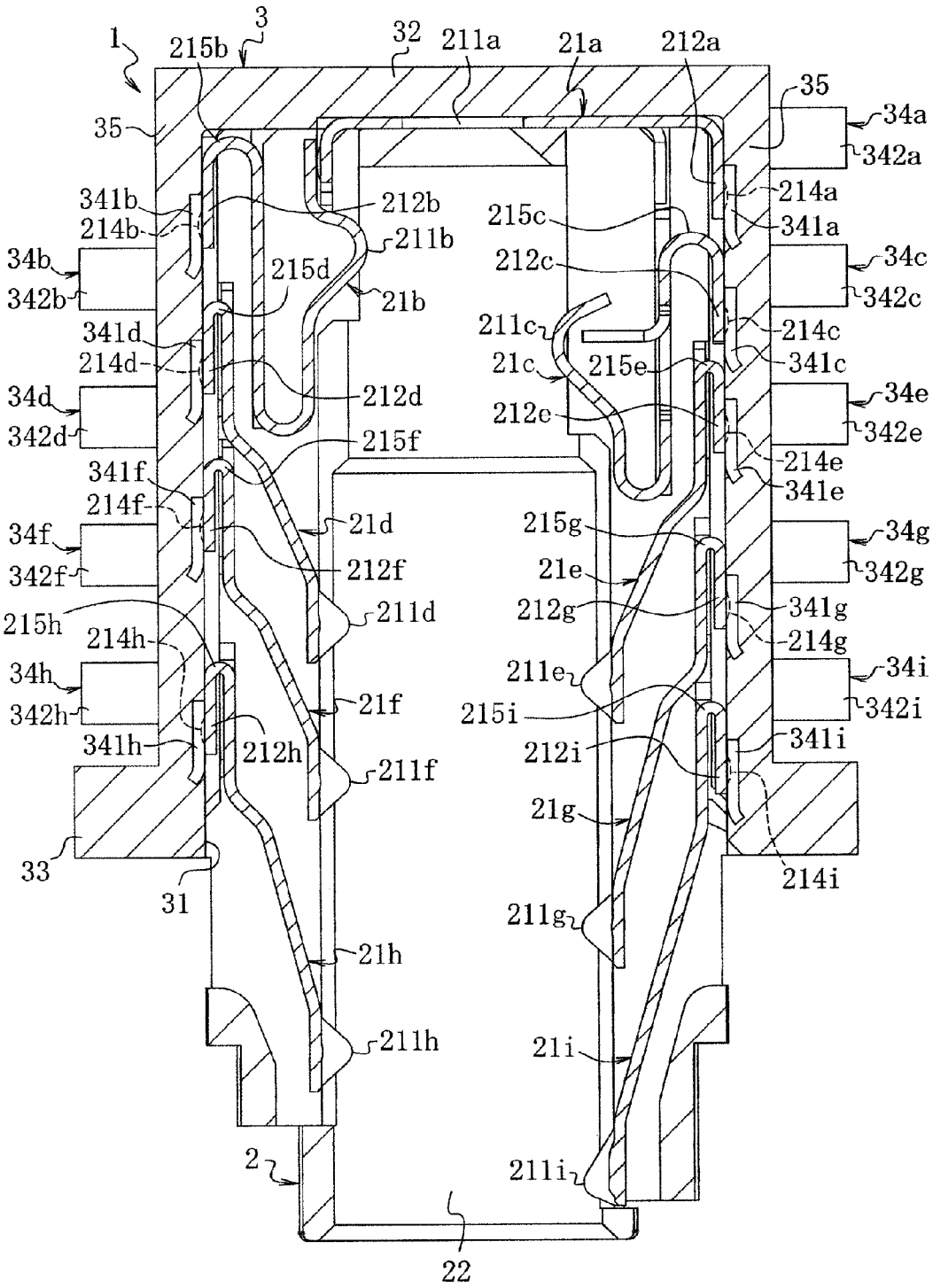
FIG. 4 is a cross-sectional view along line A-A of the multipole jack according to the embodiment.
Figure 5:
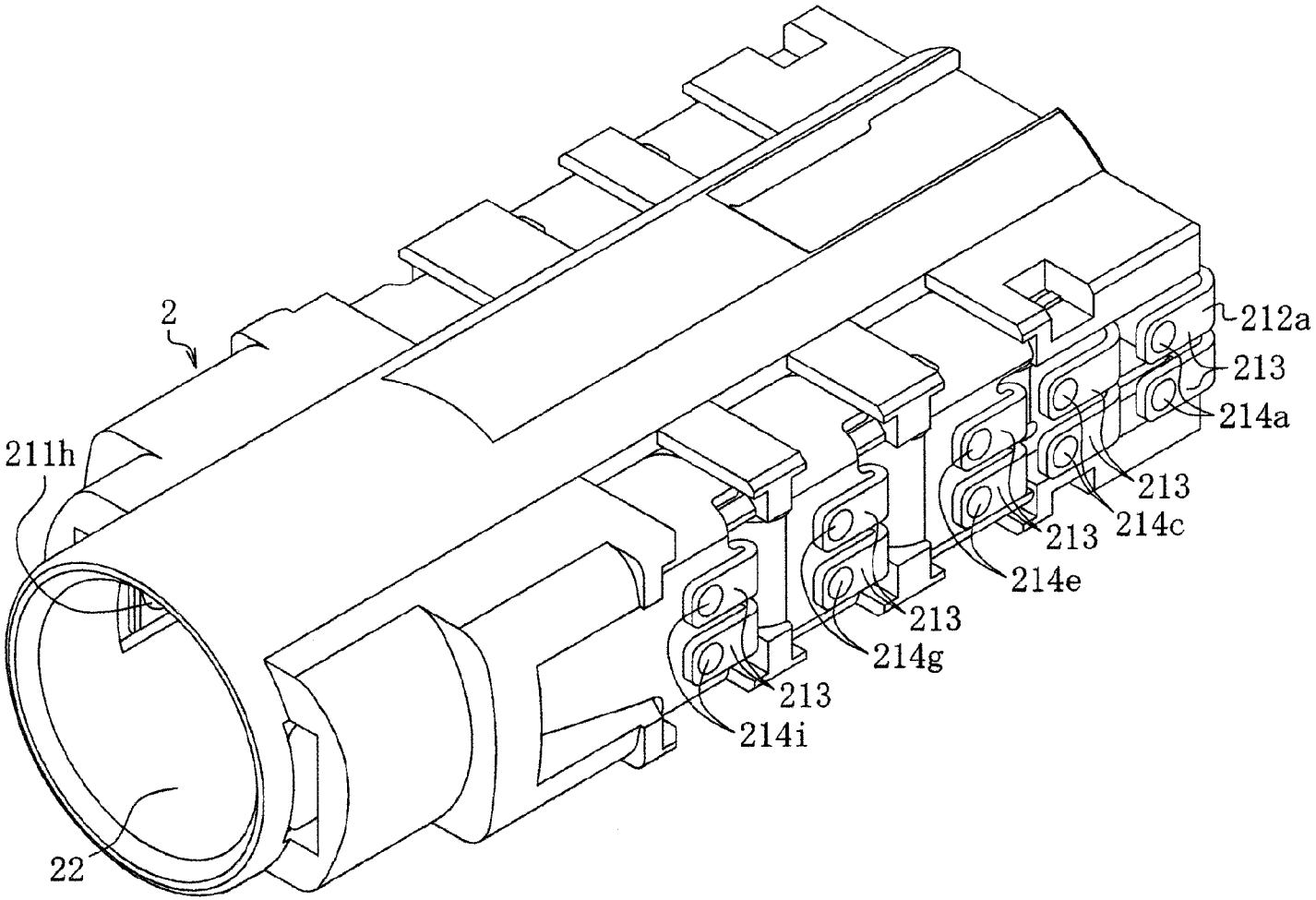
FIG. 5 is a perspective view of a main body of the multipole jack according to the embodiment.
Figure 6:
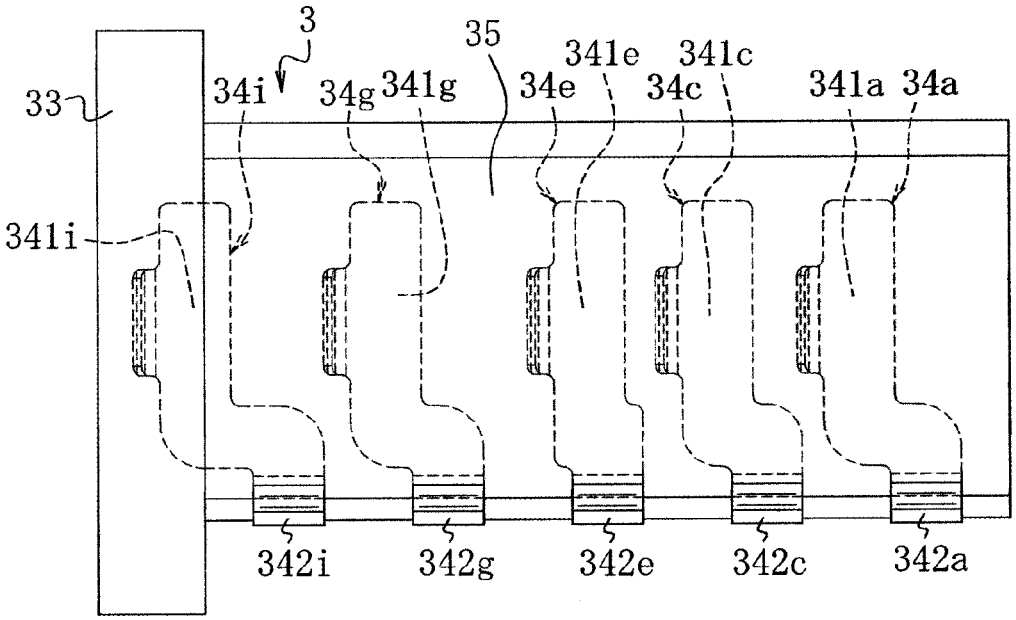
FIG. 6 is a side view of a case of the multipole jack according to the embodiment.

As illustrated in FIGS. 4 and 5, terminal bases 21*a* to 21*i* that make contact with electrodes of a multipole plug are provided in the main body 2 so as to be spaced from each other, and the terminal bases 21*a* to 21*i* are formed in an approximately planar form that is bent in a predetermined shape. A number of terminal bases 21*a* to 21*i* are provided so as to correspond to the number of poles of the multipole plug inserted, and in this example, nine terminal bases are provided so as to correspond to nine poles of the multipole plug. The number of terminal bases can be appropriately set to two or more so as to correspond to the number of poles of the multipole plug, and for example, four, five, six, seven, and eight poles or more can be used.

The terminal base 21*a* is electrically connected to a distal-end electrode of the multipole plug and includes a plug contact 211*a* disposed at a position corresponding to the deepest position of the main body 2 and a connecting end 212*a* disposed on lateral portions of the main body 2 so as to be led out from lateral sides of the main body 2. The connecting end 212*a* has a plate spring form having an approximately L-shaped bent portion and includes a plurality of (in the illustrated example, two) branching contact chips 213 having elasticity. A contact point 214*a* formed in an outwardly convex projection form is formed on an outer surface of an approximately distal end of each of the branching contact chips 213.

The terminal bases 21*b* to 21*i* are electrically connected to the corresponding cylindrical electrodes of the multipole plug and are disposed on the lateral portions of the main body 2. The plug contacts 211*b* to 211*i* provided on the inner ends of the terminal bases 21*b* to 21*i* are disposed on lateral portions of an insertion hole 22 for the multipole plug, of the main body 2. The plug contacts 211*b* to 211*i* are convex toward the inner side of the insertion hole 22. The plug contacts 211*b* to 211*i* are disposed at a predetermined interval so as to correspond to the positions of the cylindrical electrodes of the multipole plug.

Curved portions 215*b* to 215*i* which are curved in an approximately U-shape so as to be convex toward a bottom portion 32 side of the case 3 are formed on an outer-end side of the terminal bases 21*b* to 21*i*. The connecting ends 212*b* to 212*i* are provided near the bent distal ends of the curved portions 215*b* to 215*i*. The connecting ends 212*b* to 212*i* are led out from the lateral sides of the main body 2. The connecting ends 212*b* to 212*i* have a plate spring form having the curved portions 215*b* to 215*i* and each include a plurality of (in the illustrated example, two) branching contact chips 213 having elasticity. Each of contact points 214*b* to 214*i* formed in an outwardly convex projection form is formed on an outer surface of an approximately distal end of each of the branching contact chips 213.

As illustrated in FIGS. 1 to 4 and 6, in this example, the case 3 has an approximately bottomed quadrangular cylinder form, and a flange portion 33 is formed integrally around an opening 31 thereof. Extension terminals 34*a* to 34*i* having an approximately L-shaped planar form in a front view are insert-molded into the case 3 so as to protrude through side walls 35. Inner ends 341*a* to 341*i* of the extension terminals 34*a* to 34*i* are exposed to the inner side of the side walls 35 and the outer ends 342*a* to 342*i* are exposed to the outer side of the side walls 35 near a bottom plate 36. In this example, the outer ends 342*a* to 342*i* are formed so as to extend toward the lateral sides from the side walls 35, and preferably protrude downward further than the bottom plate 36. Thus, the outer ends 342*a* to 342*i* can be easily electrically connected to housing-side terminals of an electronic device, provided on a lower side of the bottom plate 36 or the lateral sides of the side walls 35 at positions on the lateral sides of the side walls 35 in a plan view, for example.

The extension terminals 34*a* to 34*i* are arranged at a predetermined interval so as to be spaced from each other in the longitudinal direction of the side walls 35 and are arranged on both side walls 35 so as to be spaced from each other. In this example, nine extension terminals 34*a* to 34*i* in total are provided such that five extension terminals are provided on one side wall 35 and four extension terminals are provided on the other side wall 33. Depending on the number of poles or the like, extension terminals may be arranged on one side wall 35 only, and the terminal bases of the main body 2 may be led out toward the corresponding side wall 35 from the lateral sides. Further, in this example, the outer ends 342*a* to 342*i* of the extension terminals 34*a* to 34*i* are arranged approximately at an equal interval and are exposed to the outer side of the side walls 35.

In a state in which the main body 2 is attached to the case 3, the main body 2 that is longer than the depth of the case 3 protrudes from the case 3, and the flange portion 33 of the case 3 is disposed at a position corresponding to an intermediate portion of the main body 2. Moreover, the connecting end 212*a* of the terminal base 21*a* of the main body 2 makes press-contact with the inner end 341*a* of the corresponding extension terminal 34*a* of the case 3 with the aid of the contact point 214*a* of the plate spring-shaped branching contact chip 213 to realize electrical connection. Further, the connecting ends 212*b* to 212*i* of the terminal bases 21*b* to 21*i* of the main body 2 make press-contact with the inner ends 341*b* to 341*i* of the corresponding extension terminals 34*b* to 34*i* of the case 3 with the aid of the contact points

214*b* to 214*i* of the plate spring-shaped branching contact chip 213 to thereby realize electrical connection.

An operation of inserting the main body 2 so as to be attached to the case 3 will be described. Since the connecting end 212*a* having the approximately L-shaped bent portion bent close to the bottom portion 32 side of the case 3 is provided, and the connecting ends 212*b* to 212*i* having the curved portions 215*b* to 215*i* that are convex toward the bottom portion 32 side of the case 3 are provided, the connecting ends 212*a* and 212*b* to 212*i* do not interfere with the extension terminals 34*a* to 34*i* during the inserting operation. Thus, it is possible to insert the main body 2 into the case 3 smoothly and to improve the manufacturing efficiency.

When the multipole jack 1 is manufactured, a process of arranging a desired number of terminal bases smaller than a predetermined number of terminal bases at appropriate positions of arrangement positions for the predetermined number of terminal bases using a mold having the arrangement positions for the terminal bases and insert-molding the desired number terminal bases into a resin in this state to form the main body 2 may be preferably used to obtain multipole jacks 1 having different numbers of poles easily. More preferably, a process of arranging the same predetermined number of extension terminals as the predetermined number of terminal bases at arrangement positions for the predetermined number of extension terminals using a mold having the arrangement positions for the extension terminals so as to correspond to the above-mentioned process, insert-molding the predetermined number of extension terminals into a resin in this state to form the case 3, and inserting the main body 2 so as to be attached to the case 3 may be used.

For example, when the main body 2 having nine terminal bases 21*a* to 21*i* of the present embodiment is formed using a mold having arrangement positions for the nine terminal bases 21*a* to 21*i*, the main body 2 can be formed by arranging the nine terminal bases 21*a* to 21*i* at all arrangement positions and insert-molding the terminal bases 21*a* to 21*i* into a resin in this state. Moreover, when the main body 2 having eight terminal bases 21*a* to 21*h* is formed using the same mold, the main body 2 can be formed by arranging eight terminal bases 21*a* to 21*h* at desired positions of the arrangement positions and insert-molding the terminal bases 21*a* to 21*h* into a resin in this state. Moreover, the case 3 may preferably be formed regardless of the number of terminal bases of the main body 2. That is, the case 3 may preferably be formed by arranging nine extension terminals 34*a* to 34*i* at all arrangement positions using a mold having arrangement positions for nine extension terminals 34*a* to 34*i* and insert-molding the extension terminals 34*a* to 34*i* into a resin in this state. The main body 2 having nine terminal bases 21*a* to 21*i* or the main body 2 having eight terminal bases 21*a* to 21*h* may be attached to the case 3 to obtain the multipole jacks 1 having different numbers of poles.

By doing so, the number of poles of the multipole jack 1 can be adjusted by adjusting the number of terminal bases of the main body 2, and the multipole jacks 1 having different numbers of poles can be manufactured using the same mold for the main body 2 and the case 3. Thus, it is possible to improve the manufacturing efficiency by sharing the manufacturing lines when manufacturing the multipole jacks 1 having different numbers of poles and to suppress the cost for expensive molds to reduce the manufacturing cost. Moreover, when the number of terminal bases is decreased, the multipole jack 1 in which extension terminals of the case 3, which do not have the corresponding terminal bases are formed as dummy extension terminals can be manufactured. Thus, a fragile resin protrusion is prevented from being formed in the dummy extension terminals of the case 3 when the multipole jacks 1 having different numbers of poles are manufactured using the same mold for the main body 2 and the case 3.

According to the multipole jack 1 of the present embodiment, terminals can be led out from the lateral sides rather than the rear side. Thus, it is possible to decrease an entire length of the multipole jack 1 and to further increase a battery size of an electronic device in which the multipole jack 1 is provided. In particular, in an electronic device having such a structure that a battery is disposed on the rear side of the multipole jack 1, by connecting the extension terminals 34*a* to 34*i* and the housing-side terminals of the electronic device on the lateral sides of the side walls 35, the rear-side space for connecting both terminals can be effectively used for the space for increasing the battery size. Thus, the battery size of the electronic device can be increased reliably.

Moreover, the terminal base 21*i* or the like having the plug contact 211*i* disposed close to the opening of the main body 2 through which the multipole plug is inserted can be shortened by being led out from the lateral sides. Thus, it is possible to decrease the length of terminals provided and to meet the demand for reducing the size of the multipole jack 1 even if the number of poles increases. Further, the deeper surface and desired upper, lower, left, and right regions of the main body 2 can be waterproofed reliably by the approximately bottomed cylindrical resin case 3. Further, since the extension terminals 34*a* to 34*i* are insert-molded into the case 3, adhesive is not removed during soldering of the extension terminals 34*a* to 34*i*. Thus, it is possible to prevent deterioration of waterproofness during soldering of the extension terminals 34*a* to 34*i* and to obtain high yield. Further, since it is only necessary to change the configuration of a jack without changing the configuration of a housing of the electronic device and an expensive housing-side mold used for manufacturing the electronic device, it is possible to reduce the manufacturing cost for the electronic device.

Moreover, since terminals are led out from both side walls 35, it is possible to easily cope with an increase in the number of poles such as five poles to ten poles larger than four poles, for example. Further, the terminal bases 21*b* to 21*i* corresponding to the cylindrical electrodes of the multipole plug are disposed on the lateral portions of the main body 2, and the connecting ends 212*a* to 212*i* of all terminal bases 21*a* to 21*i* are led out from the lateral sides and are connected to the inner ends 341*a* to 341*i* of the extension terminals 34*a* to 34*i* on the inner side of the side walls 35 of the case 3. Thus, it is possible to substantially minimize the length of the terminal bases 21*a* to 21*i* and the entire length of the terminal made up of the terminal bases 21*a* to 21*i* and the extension terminals 34*a* to 34*i*. Therefore, it is possible to design the multipole jack 1 so as to cope with an increase in the number of poles more reliably and to meet the demand for reducing the size of the multipole jack 1 reliably.

Moreover, the connecting ends 212*a* to 212*i* of the terminal bases 21*a* to 21*i* are connected by making press-contact with the extension terminals 34*a* to 34*i*. Thus, it is possible to eliminate thermal effect on the terminal bases, the extension terminals, and the surroundings thereof, which occurs when the terminal bases and the extension terminals are connected by soldering and to realize electrical connection between the connecting ends and the extension terminals more reliably and easily. Further, since a plurality of branching contact chips 213 and a plurality of contact points

214*a* to 214*i* are provided in each terminal, it is possible to secure a conduction state between the terminal bases 21*a* to 21*i* and the extension terminals 34*a* to 34*i* more reliably. Moreover, even when the spring property of one branching contact chip 213 deteriorates, a conduction state can be secured by the other branching contact chip 213.

Moreover, the flange portion 33 is formed integrally around the opening 31 of the case 3. Thus, for example, when the multipole jack 1 is attached to the housing of the electronic device by forming a packing such as a waterproof double-sided tape, an O-ring, or a silicone between a front surface (a plug-insertion-side surface) of the flange portion 33 and a predetermined portion of the housing, the flange portion 33 can prevent entrance of water into the housing from the outside of the case 3. Further, when the flange portion 33 of the case 3 is disposed at a position corresponding to an intermediate portion of the main body 2, a region between the distal end of the main body 2 and the flange portion 33 can be effectively used for various uses.

[Modified Examples of Embodiments]

In addition to the structure of each invention and each embodiment, the invention disclosed in this specification includes, within an applicable range, a structure specified by changing these partial structures to a different structure disclosed in this specification, a structure specified by adding a different structure disclosed in this specification to these structures, or a structure of a broader concept specified by deleting these partial structures to an extent by which action and effect of these structures can be achieved partially. The invention disclosed in this specification further encompasses modifications and others described below.

For example, in the above embodiment, the connecting ends 212*a* to 212*i* of the terminal bases 21*a* to 21*i* are formed in a plate spring form. However, the inner ends of the extension terminals of the case 3 may be formed in a plate spring form having a curved portion, and the inner ends of the extension terminals may make press-contact with the connecting ends of terminal bases such as plate portions to realize electrical connection. When the inner ends of the extension terminals are provided so as to have a curved portion, and the curved portion is configured to be convex toward the opening 31 of the case 3, the main body 2 can be ideally inserted to be attached to the case 3 smoothly.

Figure 7:
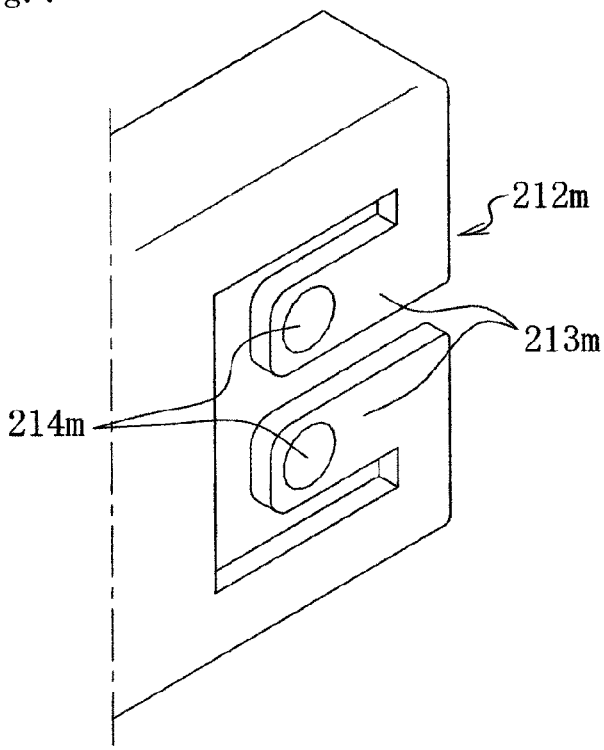
FIG. 7 is a partial perspective view illustrating a modified example of a connecting end of a terminal base.

Moreover, when the connecting ends of the main-body-side terminal bases are formed in a plate spring form or when the inner ends of the case-side extension terminals are formed in a plate spring form, the structure of the plate spring is not limited to that described in the above embodiment as long as the structure of the plate spring acts as a plate spring to be able to make press-contact. For example, as illustrated in FIG. 7, the plate of a connecting end 212*m* of the main body 2 may be cut away to form branching contact chips 213*m*, 213*m* easily. A contact point 214*m* formed in an outwardly convex projection form may be formed on an outer surface of an approximately distal end of each of the branching contact chips 213*m*. The branching contact chip 213*m* may acts as a plate spring so that the contact point 214*m* makes press-contact with an extension terminal. More preferably, the branching contact chip 213*m* may be configured to be inclined outward as it advances toward the distal end so that the spring property is enhanced, and the like.

Moreover, electrical connection between the connecting end of the terminal base of the main body 2 side and the inner end of the extension terminal of the case 3 side may be realized by means other than press-contact such as, for example, by fixing both ends using a conductive adhesive and the like to realize electrical connection. Further, the connecting end of the terminal base of the main body 3 side may have a singular contact chip, for example, rather than having a plurality of elastic branching contact chips 213.

Moreover, the electrical connection position between the inner ends 341*a* to 341*i* and the like of the extension terminals 34*a* to 34*i* protruding through the side walls 35 of the case 3 and the connecting ends 212*a* to 212*i* and the like of the terminal bases 21*a* to 21*i* is preferably between the side walls 35 of the case 3 and the lateral portions of the main body 2. However, the connection position is not limited to this. For example, the connection position may be an upper portion, a lower portion, a bottom portion, or a lateral portion of the main body 2 or a combination of desired portions among these portions. Further, the position at which the connecting ends 212*a* to 212*i* and the like of the terminal bases 21*a* to 21*i* are led out from the main body 2 is not limited to the lateral sides but can be similarly changed appropriately.

Moreover, the terminal bases 21*b* to 21*i* of the main body 2 connected electrically to the cylindrical electrodes of the multipole plug may preferably be provided on the lateral portions of the main body 2 so as to make contact with the cylindrical electrodes of the multipole plug from the lateral sides. By doing so, the terminal length can be reduced. However, one or plural, or all of the terminal bases may make contact with the cylindrical electrodes of the multipole plug from the upper side or the lower side.

Moreover, the length relation between the case 3 and the main body 2 is not limited to that described in the embodiment, and for example, the flange portion 33 of the case 3 may be configured to be positioned near the opening of the main body 2, and the like.

INDUSTRIAL APPLICABILITY

The present invention can be used in a multipole jack used for electrical connection of various electronic devices such as, for example, a multi-functional mobile phone or a mobile information terminal.

REFERENCE SIGNS LIST

1: Multipole jack
2: Main body
21*a* to 21*i*: Terminal base
211*a* to 211*i*: Plug contact
212*a* to 212*i*, 212*m*: Connecting end
213, 213*m*: Branching contact chip
214*a* to 214*i*, 214*m*: Contact point
215*b*~215*i*: Curved portion
22: Insertion hole
3: Case
31: Opening
32: Bottom portion
33: Flange portion
34*a*~34*i*: Extension terminal
341*a*~341*i*: Inner end
342*a*~342*i*: Outer end
35: Side wall
36: Bottom plate

The invention claimed is:

1. A multipole jack in which:

terminal bases that make contact with electrodes of a multipole plug are provided in an approximately cylindrical main body, connecting ends of each terminal bases are led out from the main body, the main body is attached to an approximately bottomed cylindrical resin case from an opening of the case, and inner ends of extension terminals which protrude through side walls of the case and which are insert-molded are electrically connected to the connecting ends of the corresponding terminal bases.

2. The multipole jack according to claim 1, wherein the inner ends of the extension terminals of the case are formed in a plate spring form and are connected by making press-contact with the connecting ends of the terminal bases.

3. A method for manufacturing the multipole jack according to claim 1, the method comprising:

arranging a desired number of terminal bases smaller than a predetermined number of terminal bases at appropriate positions of arrangement positions for the predetermined number of terminal bases using a mold having the arrangement positions for the terminal bases and insert-molding the desired number of terminal bases into a resin in this state to form the main body.

4. An electronic device comprising the multipole jack according to claim 1, in which the extension terminals and housing-side terminals are electrically connected at a position on the lateral sides of the side walls of the case in a plan view.

5. The multipole jack according to claim 1, wherein a flange portion is formed integrally around the opening of the case.

6. The multipole jack according to claim 5, wherein the main body has such a length that the main body protrudes from the case, and the flange portion of the case is disposed at a position corresponding to an intermediate portion of the main body.

7. The multipole jack according to claim 1, wherein the connecting ends of the terminal bases are formed in a plate spring form and are connected by making press-contact with the extension terminals of the case.

8. The multipole jack according to claim 7, wherein the plate spring-shaped connecting ends each include a plurality of elastic branching contact chips.

9. The multipole jack according to claim 7, wherein at least the plate spring-shaped connecting ends of the terminal bases corresponding to the cylindrical electrodes of the multipole plug are provided so as to have a curved portion that is curved so as to be convex toward a bottom portion side of the case.

10. The multipole jack according to claim 1, wherein the inner ends of the extension terminals provided on each of both side walls of the case are electrically connected to the connecting ends of the corresponding terminal bases.

11. The multipole jack according to claim 10, wherein the connecting ends of the terminal bases are formed in a plate spring form and are connected by making press-contact with the extension terminals of the case.

12. The multipole jack according to claim 11, wherein the plate spring-shaped connecting ends each include a plurality of elastic branching contact chips.

13. The multipole jack according to claim 1, wherein the terminal bases electrically connected to cylindrical electrodes of the multipole plug are disposed on lateral portions of the main body, and the connecting ends of all terminal bases are led out from the lateral sides of the main body.

14. The multipole jack according to claim 13, wherein the connecting ends of the terminal bases are formed in a plate spring form and are connected by making press-contact with the extension terminals of the case.

15. The multipole jack according to claim 14, wherein the plate spring-shaped connecting ends each include a plurality of elastic branching contact chips.

16. The multipole jack according to claim 10, wherein the terminal bases electrically connected to cylindrical electrodes of the multipole plug are disposed on lateral portions of the main body, and the connecting ends of all terminal bases are led out from the lateral sides of the main body.

17. The multipole jack according to claim 16, wherein the connecting ends of the terminal bases are formed in a plate spring form and are connected by making press-contact with the extension terminals of the case.

18. The multipole jack according to claim 17, wherein the plate spring-shaped connecting ends each include a plurality of elastic branching contact chips.

* * * * *